United States Patent [19]

Kondo et al.

[11] Patent Number: 4,770,257

[45] Date of Patent: Sep. 13, 1988

[54] METHOD OF PREVENTING LOSS OF DRILLING MUD DURING BORING A HOLE IN THE GROUND

[75] Inventors: Motoki Kondo, Tokyo; Hirosuke Kubota, Kawanishi; Mamoru Shinozaki, Funabashi; Toshiyuki Oshita, Hirakata; Tomohiro Teramura, Yawata; Masayasu Kitano, Kashiwara; Katsumi Shirai, Kashiwa, all of Japan

[73] Assignee: Kabushiki Kaisha Takenaka Komuten, Osaka, Japan

[21] Appl. No.: 8,123

[22] Filed: Jan. 23, 1987

Related U.S. Application Data

[63] Continuation of Ser. No. 677,311, Nov. 19, 1984, abandoned, which is a continuation of Ser. No. 404,958, Aug. 4, 1985, abandoned.

[30] Foreign Application Priority Data

Aug. 6, 1981 [JP] Japan ..... 56-124414
Aug. 7, 1981 [JP] Japan ..... 56-124522

[51] Int. Cl.[4] ..... E01D 3/12; E21B 33/138

[52] U.S. Cl. ..... 175/72; 166/295; 405/264

[58] Field of Search ..... 166/295; 175/72; 252/8.512; 405/264; 523/130, 132

[56] References Cited

U.S. PATENT DOCUMENTS

| | | | |
|---|---|---|---|
| 2,119,829 | 6/1938 | Parsons | 252/8.512 |
| 2,811,488 | 10/1957 | Nestle et al. | 252/8.512 |
| 2,867,278 | 1/1959 | Mallory et al. | 166/295 |
| 3,719,050 | 3/1973 | Asao et al. | 405/264 |
| 4,110,225 | 8/1978 | Cagle | 252/8.512 |
| 4,452,551 | 6/1984 | Arndt et al. | 405/264 |
| 4,475,847 | 10/1984 | Cornely et al. | 405/264 |
| 4,476,276 | 10/1984 | Gasper | 523/130 X |

FOREIGN PATENT DOCUMENTS

| | | | |
|---|---|---|---|
| 2436029 | 2/1976 | Fed. Rep. of Germany | 405/264 |
| 48-25205 | 7/1973 | Japan | 405/264 |
| 877102 | 8/1971 | Canada | 175/72 |

OTHER PUBLICATIONS

Rogers, Walter F., *Compositions and Properties of Oil Well Drilling Fluids*, 1st Ed., 1948, pp. 449–451.

*Primary Examiner*—George A. Suchfield
*Attorney, Agent, or Firm*—Edwin E. Greigg

[57] ABSTRACT

This invention provides a method of preventing loss of muddy water used in boring a hole in the ground by a drill bit or the like with the muddy water introduced into the hole to stabilize hole walls and to remove slime resulting from the boring. When the muddy water is getting lost to the soil, a chemical liquid comprising an isocyanate compound or including an isocyanate compound as a main component is introduced along with a fibrous filler to a depth of the hole. The position from which the muddy water is leaking is filled with the fibrous filler and is sealed with a cured product of the chemical liquid.

17 Claims, 2 Drawing Sheets

METHOD OF PREVENTING LOSS OF DRILLING MUD DURING BORING A HOLE IN THE GROUND

This is a continuation of copending application Ser. No. 677,311 filed Nov. 19, 1984, now abandoned, which is a continuation of Ser. No. 404,958 filed Aug. 4, 1984, now abandoned.

BACKGROUND OF THE INVENTION

The present invention relates to an improvement in a method of preventing drill mud loss in boring a hole in the ground. More particularly, the mentioned method is applicable to boring of a hole in the ground with drilling mud introduced into the hole for purposes of hole wall stabilization, slime removal and so forth. When the drilling mud is getting lost to the soil, a chemical liquid comprising an isocyanate compound or including an isocyanate compound as a main component is introduced into a depth of the hole to seal a position of drilling mud leakage with a cured product of the chemical liquid.

The above chemical liquid has excellent functional features from the point of view of utility and reliability. To be more particular, this chemical liquid which is insoluble to water and reactive to added water positively gelates without getting diluted or otherwise affected by the presence of underground water streams. Introduction of the chemical liquid to the leaking position is carried out easily and reliably and reliably stopping treatment is effected in a short time even in cases of deep boring since curing reaction of the chemical liquid within injection piping is checked and the chemical liquid is caused to gelate rapidly at the leaking position. Furthermore, not only is the leaking position treated but also hole walls adjacent thereto are reinforced whereby the sealed part is strong against impacts of subsequent boring. Cured product of the chemical liquid formed in the bore hole is a mass of low strength containing numerous bubbles therein, and therefore presents no problem to the subsequent boring operation.

In known methods, however, the described chemical liquid is merely introduced to the depth of the hole, and therefore a wasteful amount of the liquid is required particularly where large cracks are present as in deep rock formations. Since this kind of chemical liquid is very expensive, the prior art methods have a great disadvantage in terms of economy, and also other disadvantages such as of taking long time in some cases to provide treatment to the drilled mud leakage.

SUMMARY OF THE INVENTION

Having regard to the state of the art noted above, the object of the present invention is to provide a drilling mud loss preventing method which works quickly and reliably by extremely simple steps and with a small supply of the chemical liquid regardless of crack sizes. According to the method of the invention, the engineering operation is carried out to economic advantage and within a short period of time. This method is particularly useful for boring holes on large scales and very deep into the earth such as boring oil wells.

In order to achieve the above object the method according to this invention is characterized in that a fibrous filler for the leaking position is introduced into the depth of the hole simultaneously with or prior to the introduction of the chemical liquid.

More specifically, by reason of the fibrous nature of the mentioned filler, the latter will easily engage with surfaces of the leaking position at an opening or adjacent the opening thereof, and also the filler entwines itself in a concentrated manner thereby forming a layer of filter which offers added flow resistance and reduces permeation speed of the chemical liquid. Thus an effective check is made on a large amount of the chemical liquid unnecessarily flowing off to a distance from the bore hole. In addition, turbulence occurs in the chemical liquid when passing through the filter layer, and this aids in mixing contact between the chemical liquid and underground water or the muddy water, which assures reaction of the chemical liquid. As a result the amount of the chemical liquid used as saved and the drilling mud leaks are stopped quickly and reliably. The cured reaction product containing the filler provides a strong and highly reliable sealing.

According to a preferred embodiment of the present invention, the filler carries a chemical preparation including a catalyst to promote the curing reaction of the described chemical liquid. This feature facilitates the curing reaction at appropriate speed of the chemical liquid upon contact with the filler after the chemical liquid has been kept uncured. Consequently the chemical liquid can be delivered to a desired position easily and reliably regardless of the scale and depth of the leakage, and yet the chemical liquid is allowed to cure in a positive and reliable manner while the chemical liquid is checked at the desired position from flowing away and getting lost. Accordingly a further saving of the chemical liquid used is achieved and the leakage of the muddy water is stopped quickly and reliably, with the filler containing solid reaction product providing a strong and highly reliable sealing.

Other objects and advantages of the present invention will be apparent from the following description.

BRIEF DESCRIPTION OF THE DRAWINGS

The drawings show by way of example a method of preventing drilling mud loss in boring a hole in the ground according to the present invention, in which.

DETAILED DESCRIPTION OF THE PREFERRED EMBODIMENTS

Figure 1A:
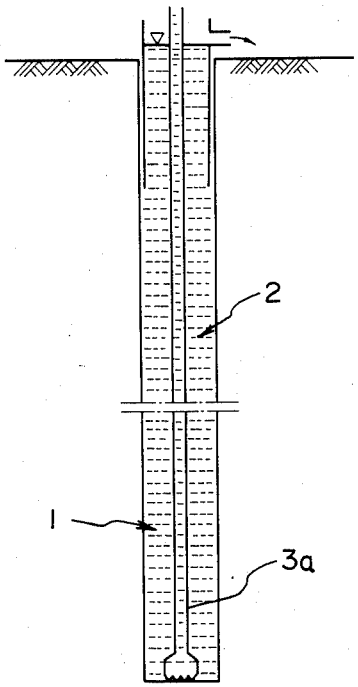
FIGS. 1(*a*) and (*b*) are views illustrating the subject method as employed, FIGS. 2(*a*) and (*b*) are views showing how a drilling mud leakage is stopped by the subject method, FIGS. 3(*a*), (*b*) and (*c*) are views illustrating a modified method as employed, and FIGS. 4(*a*) and (*b*) are views showing how a drilling mud leakage is stopped by the modified method.
Figure 1B:
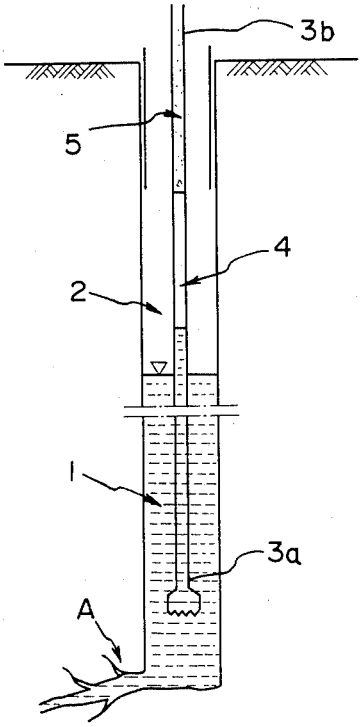
Figure 2A:
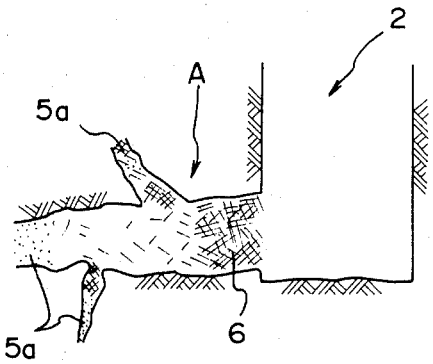
Figure 2B:
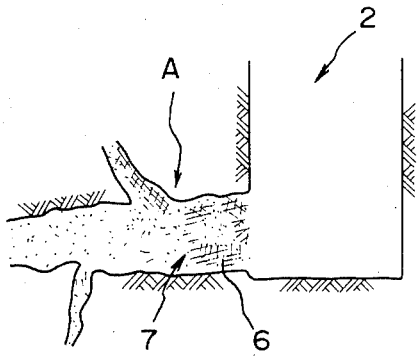

One mode of practicing the invention is now described with reference to FIGS. 1 and 2. As shown in FIG. 1(*a*), mud 1 containing bentonite or the like has been introduced into a hole 2 formed in the ground for purposes of hole wall stabilization and slime removal. In this state the hole 2 is bored by a drill bit 3*a* to form an oil well or a natural gas well.

Referring to FIG. 1(*b*), the bottom of the hole 2 encounters a muddy water leaking position A from which the muddy water gets lost to the soil whereby the level of the water surface lowers. Then the drill bit 3*a* is slightly withdrawn upward, and a spacer liquid 4 comprising, for example, liquid paraffin, a solvent with an adjusted specific gravity or the like which floats on the muddy water 1 and which is heavier than and does not react to an isocyanate compound is introduced into a drill rod 3*b*, and thereafter a chemical liquid 5 mixed with a fibrous filler is introduced into the drill rod 3*b*. The muddy and other waters are driven out of the drill rod 3*b* by the spacer liquid 4 in order that the chemical liquid 5 does not mix with the drilling mud 1 and the curing reaction of the chemical liquid 5 does not begin inside the drill rod 3*b*. Thus the chemical liquid 5 is fed via the drill bit 3*a* into the depth of the hole 2.

The chemical liquid 5 supplied to the hole from the extreme end of the drill bit 3*a* comes into contact with water from the first time and the reaction begins at the timing governed by the amount of a curing reaction promoting catalyst or a reaction inhibitor. The reacting chemical liquid 5 and the filler enter the drilling mud leaking position A together with the drilling mud 1, and the filler 6 entwines on the location relatively close to the opening of the leaking position A to form a layer of filter and check the loss of the chemical liquid 5, as seen from FIG. 2(*a*). As the leading part 5*a* of the chemical liquid 5 completes its reaction with water, a solid reaction product is formed in a depth of the crack first and then successively toward the opening of the leaking position A thereby to prevent the chemical liquid from flowing farther away. The solid product 7 containing the layer of filler 6 grows to the entirety of the crack and ultimately seals the drilling mud leaking position A, as seen from FIG. 2(*b*).

Figure 3A:
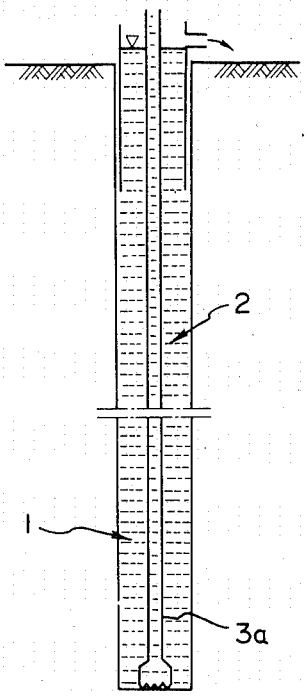
Figure 3B:
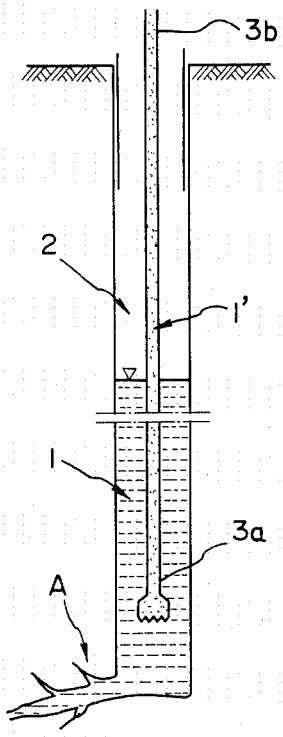
Figure 3C:
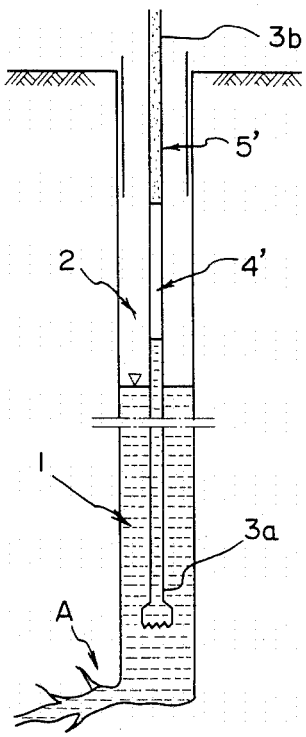
Figure 4A:
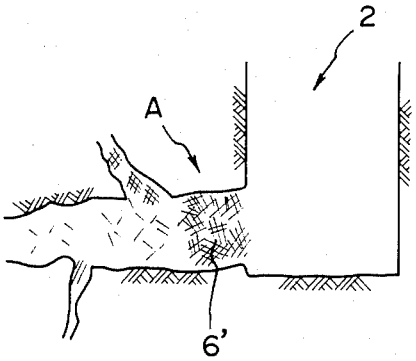
Figure 4B:
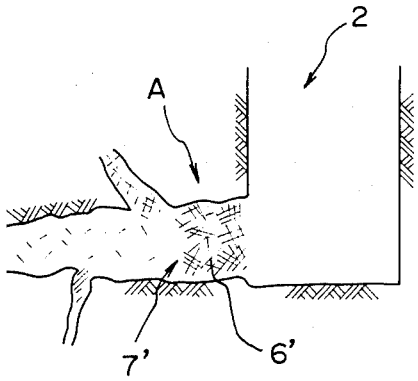

A further method according to the present invention is now described with reference to FIGS. 3 and 4. Referring to FIG. 3(*a*), a hole 2 is bored in the ground by a drill bit 3*a* to form an oil well or a natural gas well, with drilling mud 1 containing bentonite or the like introduced into the hole 2 as in the case shown in FIG. 1(*a*).

Referring to FIG. 3(*b*), when the bottom of the hole 2 encounters a drilling mud leaking position A, the drill bit 3*a* is slightly withdrawn upward and a filler carrying a chemical preparation including a curing reaction promoting catalyst is introduced as mixed into drilling mud 1' to the interior of the drill rod 3*b* and is allowed to reach the depth of the hole 2. Consequently, the filler supplied to the hole 2 flows together with the drilling mud 1 to the leaking position A, and entwines on a location relatively close to the opening of the leaking position A to form a layer of filter there, as seen from FIG. 4(*a*).

Referring to FIG. 3(*c*), a spacer liquid 4' comprising liquid paraffin or the like which floats on the drilling mud and does not react with the chemical liquid as in the case shown in FIG. 1(*b*), is next introduced into the drill rod 3*b*, and thereafter the chemical liquid 5' is introduced into the drill rod 3*b*. The drilling mud is driven out of the drill rod 3*b* by the spacer liquid 4' in order that the chemical liquid 5' does not start the curing reaction inside the drill rod 3*b*. Thus, the chemical liquid 5' is fed via the drill bit 3*a* into the depth of the hole 2. The loss of the chemical liquid 5' is checked by the action of the filter layer defined by the filler 6', and the reaction of the chemical liquid 5' is accelerated by the catalyst carried by the filler 6'. The solid reaction product of the chemical liquid 5' grows, containing the filler layer, and seals the drilling mud leaking position A in an extremely effective manner, as shown in FIG. 4(*b*).

The mentioned chemical liquid 5, 5' includes as a main component an isocyanate compound whose general formula is R—(NCO)n, and reacts with water to polymerize and form water-insoluble polymer gels while generating carbon dioxide gas. In the above general formula, R is an aliphatic or aromatic group or an organic group consisting of the above two, and n is desirably 2 or an integer greater than 2. Typical examples of the isocyanate compound used in this invention include; aromatic or aliphatic polyisocyanates such as 2, 4-tolylene diisocyanate, 2, 6-tolylene diisocyanate, a mixture of 2, 4- and 2, 6-tolylene diisocyanates, 4, 4-diphenylmethan diisocyanate, 1, 5-naphthylene diisocyanate, polymethylene polyphenyl isocyanate, bi-tolylene diisocyanate, m-pheneylene diisocyanate, 1, 6-hexamethylene diisocyanate, o- or m- or p-xylylene diisocyanate, methylene bis-p-phenylene diisocyanate, 2, 6-diisocyanate methylcaproate, and so on, or prepolymers having isocyanate groups, the prepolymer being derived from the above isocyanate compounds and polyols such as polyether glycol having active hydrogens.

The isocyanate compound may be added with suitable chemicals in suitable amount such as diluents comprising one or a mixture of benzene, xylene, toluene, acetone, methylethyl ketone, ethyl acetate, trichloroethylene, dibutyl phthalate, dioctyl phthalate, dioctyl adipate, tricresyl phosphate, and so forth, or non-ionic silicone surfactant or other surfactants, or other additives.

The curing reaction promoting catalyst used for the varied isocyanate compounds as carried by the filler may be selected from tertiary amines such as triethyl amine, N-methyl morpholine, N-ethyl morpholine, dimethyl benzylamine, triethylene diamine, N, N'-dimethyl-2-methyl piperazine, dimethyl laurylamine, dimethyl coconutsamine, and so forth, or from organometallic compounds such as dibutyl tin-laurate, stannous octate, and so forth.

The fibrous filler 6, 6' may comprise one or a combination of varied fibrous materials such as asbestos tailing, hay, wood shavings, pulp, glass fiber, cotton, feather, straw, and squeezed cotton seeds. In particular, materials having no active hydrogen are desirable since such materials do not react with isocyanates.

The filler may be given varied pre-treatments such as dimension adjustment, particle size adjustment, moisture content regulation, and washing.

To carry the curing reaction promoting catalyst or other chemicals, the filler may simply absorb or adsorb the chemicals in liquid state.

In delivering the filler into the hole bored in the ground, large filler pieces may be delivered first to narrow the opening of the leaking position, which is followed by small filler pieces to provide adequate filling. There are varied other manners in which the chemical liquid and the filler are delivered into the hole.

It will be understood that the present invention is applicable to boring of holes for varied purposes.

We claim:

1. A method for stabilizing holes and cracks in a wall of a borehole during drilling said borehole by use of a drill bit to prevent a loss of drilling mud and to remove slime during said drilling comprising:

(a) introducing an inorganic fibrous filler into said hole at a depth of said hole or crack to be stabilized to form a filter layer;

(b) introducing a chemical liquid comprising an isocyanate compound into said hole at a depth of said hole or crack and of said inorganic fibrous filler, in which said inorganic fibrous filler acts as a sealing material to prevent large amounts of said chemical liquid from escaping through said crack and to promote curing of the chemical liquid; and (c) reacting said isocyanate compound with water to polymerize and form water insoluble polymer gels of said isocyanate compound and said fibrous filler, whereby said polymer gels seal said hole or crack.

2. A method as set forth in claim 1 which includes:

introducing a spacer liquid into said hole prior to introduction of said inorganic fibrous filler and chemical liquid.

3. A method as set forth in claim 1 which includes withdrawing said drill bit to a depth slightly above said crack to be stabilized, and said inorganic fibrous filler and said chemical liquid are introduced through said drilling bit to the depth of said crack.

4. A method as set forth in claim 2 which includes:

withdrawing said drill bit to a depth slightly above said crack to be stabilized, and said spacer liquid, said inorganic fibrous filler and said chemical liquid are introduced through said drilling bit to the depth of said crack.

5. A method as claimed in claim 2 wherein:

said inorganic fibrous filler is introduced before said chemical liquid.

6. A method as claimed in claim 3 wherein:

said inorganic fibrous filler is introduced before said chemical liquid.

7. A method as claimed in claim 4 wherein:

said inorganic fibrous filler is introduced before said chemical liquid.

8. A method as set forth in claim 2 in which:

said inorganic fibrous filler and said chemical liquid are introduced into the drilled hole simultaneously.

9. A method as set forth in claim 3 in which:

said inorganic fibrous filler and said chemical liquid are introduced into the drilled hole simultaneously.

10. A method as set forth in claim 4 in which:

said inorganic fibrous filler and said chemical liquid are introduced into the drilled hole simultaneously.

11. A method as claimed in claim 1 which includes:

adding a catalyst to said inorganic fibrous filler in order to promote the curing reaction of said chemical liquid..

12. A method as claimed in claim 2 which includes:

adding a catalyst to said inorganic fibrous filler in order to promote the curing reaction of said chemical liquid.

13. A method as claimed in claim 3 which includes:

adding a catalyst to said inorganic fibrous filler in order to promote the curing reaction of said chemical liquid.

14. A method as claimed in claim 4 which includes:

adding a catalyst to said inorganic fibrous filler in order to promote the curing reaction of said chemical liquid.

15. A method as claimed in claim 5 which includes:

adding a catalyst to said inorganic fibrous filler in order to promote the curing reaction of said chemical liquid.

16. A method as claimed in claim 6 which includes:

adding a catalyst to said inorganic fibrous filler in order to promote the curing reaction of said chemical liquid.

17. A method as claimed in claim 7 which includes:

adding a catalyst to said inorganic fibrous filler in order to promote the curing reaction of said chemical liquid.

* * * * *